US006186375B1

(12) United States Patent
Chrisco et al.

(10) Patent No.: US 6,186,375 B1
(45) Date of Patent: Feb. 13, 2001

(54) PUSH-PULL SPOUT ASSEMBLY

(75) Inventors: Larry L. Chrisco, Fairland; Charles L. Forbis, Quapaw, both of OK (US)

(73) Assignee: Blitz U.S.A., Inc., Miami, OK (US)

( * ) Notice: Under 35 U.S.C. 154(b), the term of this patent shall be extended for 0 days.

(21) Appl. No.: 09/353,390

(22) Filed: Jul. 15, 1999

(51) Int. Cl.[7] ..... B67D 3/00
(52) U.S. Cl. ..... 222/523; 222/525; 141/218
(58) Field of Search ..... 222/522, 523, 222/525; 141/286, 290, 302, 218

(56) References Cited

U.S. PATENT DOCUMENTS 1,862,973 * 6/1932 McDonald ..... 222/522
4,807,785 * 2/1989 Pritchett ..... 222/442
4,979,655 * 12/1990 Gallucci ..... 222/519
5,135,140 * 8/1992 Maguire et al. ..... 222/521
5,337,931 * 8/1994 Kitterman ..... 222/525
5,419,467 5/1995 Maguire et al. .
5,890,633 * 4/1999 Skillin et al. ..... 222/523

* cited by examiner

*Primary Examiner*—Kevin Shaver
*Assistant Examiner*—Melvin A. Cartagena
(74) *Attorney, Agent, or Firm*—Hovey, Williams, Timmons & Collins

(57) ABSTRACT

The push-pull spout assembly (10) is configured to dispense fluid materials from a container (12). The spout assembly (10) includes a pair of generally tubular, telescopically interfitted first (20) and second members (54) defining a fluid passageway (22). Each member includes a complemental closure wall (30,58) projecting into the fluid passageway (22). In a blocking position the complemental walls (30,58) are aligned and block fluid flow through the passageway (22) and in an offset position the members (20,54) are shifted axially relative to one another to allow fluid flow through the passageway.

15 Claims, 2 Drawing Sheets

10
12
14
20
22
24
26
28
30
32
34
36
38
40
42
44
46
48
50
52
54
56
58
60
62
64
66
68
70
72
74
76
78
80

PUSH-PULL SPOUT ASSEMBLY

BACKGROUND OF THE INVENTION

1. Field of the Invention

This invention relates to the field of fluid containers and to a device to assist in neatly pouring the contents of the container. More particularly, the invention is concerned with a pouring spout which can be selectively opened and closed when attached to a container.

2. Description of the Prior Art

Many products are stored in containers and are dispensed for use by pouring them from their containers. By using a spout or funnel, a person can prevent spills. However, most funnels and spouts do not allow the user to stop the flow of fluid or selectively control the amount and rate of fluid being dispensed. There has thus developed a need for a pouring spout that allows the user to stop the flow of fluid or selectively control the amount of fluid being dispensed and yet still be simple and reliable to use and inexpensive to make.

SUMMARY OF THE INVENTION

The push-pull spout assembly broadly includes a pair of telescopically coupled cooperating first and second tubular members for dispensing fluids from a container to which the spout assembly has been connected. The first and second members cooperatively define a fluid passageway. The first member includes a coupler for connecting the spout assembly to the container. The first and second members include complemental closure walls projecting into the fluid passageway. The complemental walls are selectively positionable in a blocking position, in which they are horizontally aligned and block the flow of fluid through the passageway, and an offset position, in which the walls are shifted axially relative to one another and out of horizontal alignment to permit the flow of fluid through the passageway.

In preferred forms, the tubular members are circular in cross section and are each integrally formed from a synthetic resin. The complemental closure walls are semicircular in shape and are generally similar in size. The second member includes a pin and the first member includes a slot that receives the pin. The slot limits the travel of the pin, and thus the second member with respect to the first member, to one condition corresponding with the blocking position and a second condition corresponding to the offset, flow permitting position.

DETAILED DESCRIPTION OF THE PREFERRED EMBODIMENT

Figures 1, 2, 3:
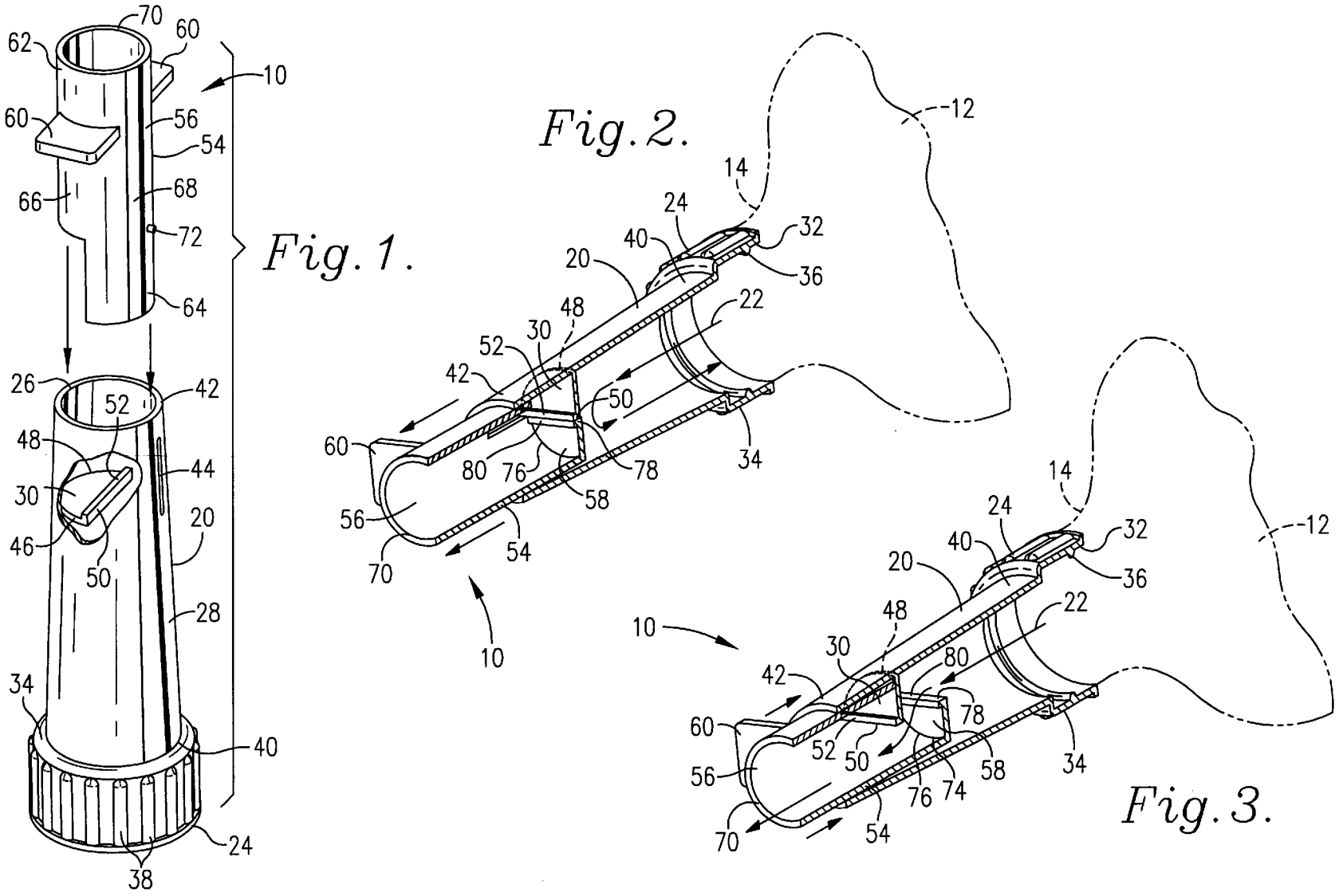
FIG. 1 is an exploded, perspective view of a push-pull spout assembly according to the present invention and with a portion of the first member removed for illustration.
FIG. 2 is a central longitudinal cross sectional view of the push-pull spout assembly of FIG. 1 illustrating a blocking, closed position.
FIG. 3 is a central longitudinal, cross-sectional view ofthe push-pull spout assembly of FIG. 1 illustrating an offset, open position.

FIGS. 1 and 2 illustrate a preferred push-pull spout assembly 10. The push-pull spout assembly 10 is configured to be connected to a container 12 for dispensing fluids and other flowable materials. The container 12 includes a neck 14 that surrounds an opening 16 of the container 12. The neck 14 includes external threads 18 on which a cap (not shown) may be secured. The push-pull spout assembly 10 generally comprises a pair of generally tubular members that are telescopically intermitted to define a fluid passageway 22.

The first member 20 preferably has a circular cross-section but could be formed with other geometric shapes such as oval, square, rectangular or other polygons. The first member includes a coupler 24, a generally circular opening 26, a first elongated frusta conical sidewall 28 and a first complemental closure wall 30. The coupler 24 is generally circular in cross section and includes an inside coupler wall 32 and an outside coupler wall 34. The inside coupler wall 32 includes female threads 36 adapted to couple with the external threads 18 of the neck 14 of the container 12. The outside coupler wall 32 includes circumferentially spaced ribs 38 that provide a finger grip thereby assisting the user in securing the spout assembly 10 onto the container 12. The coupler 24 is located at one end 40 of the elongated side wall 28. At the other end 42 of the elongated side wall 28 is the generally circular first opening 26. The side wall 28 includes an elongated slot 44 in the form of a longitudinally extending opening defined in the side wall 28, the purpose of which is described below.

As shown in FIGS. 1, 2 and 3, the first complemental closure wall 30 is semicircular in shape. Wall 30 includes a perimeter 46 having and an arcuate portion 48 and a flat portion 50. The arcuate portion 48 merges with the interior of side wall 28. The flat portion 50 has a raised edge 52 along its length making the flat portion 50 thicker than the arcuate portion 48. Complemental wall 30 projects into and partially obstructs the passageway 22. It is sized to block a portion of the fluid passageway 22. Preferably, the wall 30 fills substantially half of the fluid passageway 22 although other fractions are within the scope of the invention.

The second generally tubular member 54 includes an elongated side wall 56, a second complemental closure wall 58 and a pair of external flanges 60. The side wall 56 includes cylindrical upper portion 62 and a lower portion 64. The lower portion 64 is generally semicircular in cross section and includes a first end 66 and a second end 68. The first end 66 of the lower portion 64 is connected to the second complemental wall 58. The second end 68 merges into the upper portion 62 of the second sidewall 56.

Figure 4:
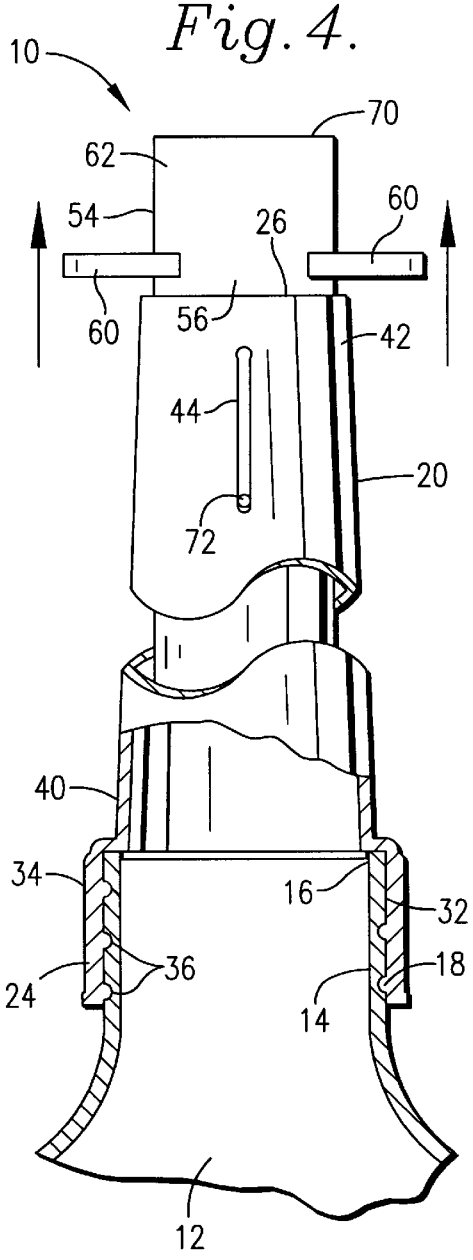
FIG. 4 is a side elevational view of the push-pull spout assembly of FIG. 1 in combination with a container, the assembly having a portion removed for illustrating an offset, open position.
Figure 5:
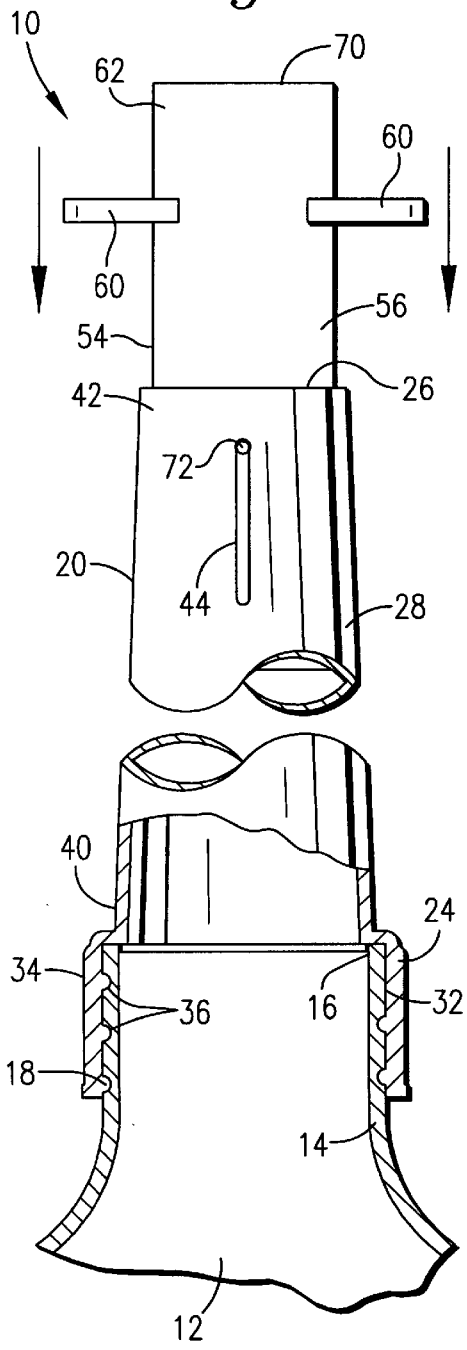
FIG. 5 is a side elevational view of the push-pull spout assembly of FIG. 1 in combination with a container, the assembly having a portion removed for illustrating a blocking, closed position.

FIGS. 1, 4, and 5 illustrate that the upper portion 62 of the sidewall 56 is generally circular in cross section and defines a second passageway 82. The upper portion 62 includes a generally circular end opening 70 and a pin 72. The pin 72 is generally cylindrically shaped and extends outward from the wall of tubular member 54. The flanges 60 extend perpendicularly outward from the upper portion 62 of the side wall 56 and are both generally rectangular in shape. The flanges 60 are positioned generally opposite from each other along the side wall 56.

As shown in FIGS. 2 and 3, the second complemental wall 58 is generally semicircular in shape and is substantially similar in size to the first complemental wall 30. The second complemental wall 58 includes a perimeter 74 having and an arcuate portion 76 and a flat portion 78. The arcuate portion 76 merges with the side wall 56. The flat portion 78 has a raised edge 80 along its length making the flat portion 78 thicker than the arcuate portion 76. The second complemental wall 58 also projects into the passageway 22. The second complemental wall 58 is configured to project into and partially obstruct the fluid passageway 22. The second closure wall 58 blocks the portion of the passageway 22 not filled by the first complemental wall 30. The flat portion 78 is configured to abut the flat portion 50 of the first complemental closure wall 30 thereby substantially blocking flow through passageway 22. The increased thickness of the flat portions provides additional contact area to enhance the seal therebetween.

To assemble the spout assembly 10, the cylindrical second member 54 is inserted into the generally circular opening 26 of the first member 20, as illustrated by FIG. 1. The first sidewall 28 of the first member 20 is yieldably resilient to allow the pin 72 to be snapped into the slot 44. Once the pin 72 is received in the slot 44, the slot 44 limits the axial travel of the pin 72 between a first condition and a second condition.

As shown in FIGS. 2 and 3, in the first closed position (see FIG. 2), the complemental walls 30, 58 are horizontally aligned, thereby blocking flow through the passageway 22. To open the passageway 22, the user can shift the second member 54 relative to the first member 20, by applying a force to the flanges 60. The axial shifting of the members spaces apart and offsets the complemental closure walls 30, 58, thereby allowing fluid to flow through the passageway 22. Once the full open position (see FIG. 3) has been reached, the complemental walls 30, 58 are in their most offset position and the greatest amount of flow is permitted through the passageway 22. The moveable, second closure wall is closer to the coupler in the closed position than in the open position, so that the fluid flow direction biases the second closure wall toward the closed position.

Those skilled in the art will now appreciate the benefits of the present invention. For example, the two-piece construction of the spout assembly 10 allows a manufacturer to inexpensively produce the assembly Also, because the design is easy to use, a person will be less likely to spill hazardous or other fluids while dispensing them from the container 12.

Those skilled in the art will also appreciate that the present invention encompasses many variations in the preferred embodiments described herein. For example, the preferred embodiment uses synthetic resin material to form the separate components, however other materials such as metal or rubber could also be employed. Also, the preferred embodiment uses rectangular flanges 60, but any shape of flange could be used to assist the user in axially shifting the two members relative to one another. Further, the complemental walls 30, 58 are semicircular in shape, but any shapes which cooperatively block off flow in the fluid passageway 22 could be employed.

Having thus described the preferred embodiments of the present invention, the following is claimed as new and desired to be secured by Letters Patent:

What is claimed is:

1. A push-pull spout assembly for dispensing fluids from a container, the assembly comprising:

a pair of telescopically coupled first and second members cooperatively defining a fluid passageway, said first member including a coupler for connecting the spout assembly to the container, said members including complemental closure walls projecting into the passageway and being selectively positionable in a blocking position, in which they are aligned and block flow through the passageway, and an offset position to permit flow through the passageway, when the members are shifted axially relative to one another, said complemental closure walls being generally semicircular in shape and substantially similar in size.

2. The push-pull spout assembly as set forth in claim 1, said members are tubular and have circular cross sections.

3. The push-pull spout assembly as set forth in claim 1, said second member being received in said first member.

4. The push-pull spout assembly as set forth in claim 1, in combination with the container, said container including a neck having external threads, the assembly including a coupler having female threads adapted to cooperate with the external threads of the neck to attach the assembly to the container.

5. The push-pull spout assembly as set forth in claim 1, said second member including a semicircular sidewall, one of said complemental closure walls being attached to one end of said semicircular sidewall.

6. The push-pull spout assembly as set forth in claim 1, said first and second members each comprising generally cylindrically shaped tubes, formed from synthetic resin material.

7. The push-pull spout assembly as set forth in claim 1, said second member including at least one external flange to assist shifting the second member axially relative to the first member.

8. The push-pull spout assembly as set forth in claim 7, said at least one external flange comprising a pair of opposed external flanges.

9. The push-pull spout assembly as set forth in claim 1, said second member being telescopically receiving in said first member.

10. The push-pull spout assembly as set forth in claim 1, said first member including a slot, said second member including a pin which is received in said slot, said slot limiting the axial travel of said pin from a position corresponding with said blocking position to a position corresponding to said open position.

11. The push-pull spout assembly as set forth in claim 1, said first member including a coupling end and a top end, said complemental wall of said first member being generally centrally located between said ends.

12. A push-pull spout assembly for dispensing fluids from a container comprising:

a pair of generally tubular first and second members cooperatively defining a fluid passageway, said first and second members being generally cylindrical in shape;

said second member being axially shiftable relative to said first member between a blocking position and an offset open position said members including complemental walls projecting into the passageway, in said walls being aligned in said blocking position to block flow through the passageway; in said offset position, said walls being shifted axially relative to one another allowing fluid to flow through the passageway, said complemental walls being generally semicircular shaped and generally similar in size.

13. The push-pull spout assembly as set forth in claim 12, said first and second members being telescopically interfitted.

14. The push-pull spout assembly as set forth in claim 12, said first and second members including a stop that allows the members to shift axially only between the blocking position and the offset position.

15. The push-pull spout assembly as set forth in claim 12, said first member including a slot, said second member including a pin, said stop including the slot and the pin that is configured to be slidingly received within said slot.

* * * * *